US005337649A

United States Patent [19]

Franzén et al.

[11] Patent Number: 5,337,649

[45] Date of Patent: Aug. 16, 1994

[54] DEVICE FOR CONTROLLING AMMUNITION UNITS DISCHARGED IN SALVOS BY CHARGES COMPOSABLE FROM PART CHARGES

[75] Inventors: Arne Franzén, Karlskoga; Larseric Larsson, Degerfors; Neile Nilsson, Karlskoga; Lars-Berno Fredriksson, Kinnahult, all of Sweden

[73] Assignee: Bofors AB, Karlskoga, Sweden

[21] Appl. No.: 945,328

[22] Filed: Sep. 16, 1992

[30] Foreign Application Priority Data

Sep. 16, 1991 [SE] Sweden ..... 9102672-4

[51] Int. Cl.[5] ..... F41A 1/06

[52] U.S. Cl. ..... 89/14.05; 89/33.04; 89/45; 89/41.03; 102/705

[58] Field of Search ..... 89/1.3, 1.35, 1.703, 89/14.05, 33.04, 34, 45; 102/282, 373, 430, 443, 705

[56] References Cited

U.S. PATENT DOCUMENTS

| | | | |
|---|---|---|---|
| 68,609 | 9/1867 | Crockett | 102/443 |
| 540,328 | 6/1895 | Maxim | 102/443 |
| 3,730,050 | 5/1973 | Goldin et al. | 89/1.3 |
| 3,739,152 | 6/1973 | Frohock et al. | 364/423 |
| 3,956,966 | 5/1976 | French | 89/41.03 |
| 4,655,411 | 4/1987 | Franzen et al. | 244/3.11 |
| 4,706,544 | 11/1987 | Zielinski et al. | 89/34 |
| 5,121,672 | 6/1992 | Haglund | 89/41.03 |

FOREIGN PATENT DOCUMENTS

| | | | |
|---|---|---|---|
| 602386 | 3/1926 | France | 102/443 |
| 13994 | 7/1901 | Sweden . | |
| 264945 | 2/1950 | Switzerland | 102/443 |

OTHER PUBLICATIONS

Farrar et al, Military Ballistics A Basic Manual, 1983, pp. 18–20.

*Primary Examiner*—Stephen C. Bentley

*Attorney, Agent, or Firm*—Pollock, Vande Sande & Priddy

[57] ABSTRACT

A device for controlling discharge of ammunition units from the barrel of a gun in sequence with muzzle velocities within a large velocity range, enables simultaneous activation of the ammunition units on a target area. The device comprises a plurality of part charges having different predetermined compositions including sizes, types, powder varieties, powder dimensions, and being combinable into plurality of selected combinations defining total charges. A controlling device is provided for receiving information regarding the firing parameters and parameters influencing muzzle velocity including powder temperature of the part charges and pressure in the gun barrel and for calculating relevant velocities from the large range of velocities which allow for plurality of sequentially fired ammunition units to simultaneously arrive at the target area. Also selector devices are provided, responsive to the controlling device for selecting from the plurality of part charges, based on the calculated velocities, corresponding combinations of part charges to define the total charges for respective ammunition units which allow to achieve the calculated velocities with high accuracy.

8 Claims, 3 Drawing Sheets

DEVICE FOR CONTROLLING AMMUNITION UNITS DISCHARGED IN SALVOS BY CHARGES COMPOSABLE FROM PART CHARGES

TECHNICAL FIELD

The present invention relates to a device used in combatting targets by using ammunition units which are dischargeable from guns, to enable temporally accurate, simultaneous activations of the ammunition units or ammunition parts included therein on or within target areas. The ammunition units are dischargeable from the barrel of the gun by means of charges which may be composed of part charges.

The present invention also relates to a method for selecting one or more combinations of different part charges for their compositions in common charges for ammunition units dischargeable from the above-mentioned guns.

BACKGROUND OF THE INVENTION

It is previously known in the art to employ temporally accurate activations of ammunition units at or on target areas. Among other things, it is previously known to discharge, from one and the same gun, salvos of ammunition units which are activated at the same time on the target area for efficient combatting thereof. As a result of this process, the risk will be avoided that the enemy is warned by the first round of the salvos and will have time to withdraw from the effects of subsequent rounds. In such instances, the ammunition units must be capable of being discharged at different angles of elevation of the gun, at different muzzle velocities, different cycles in the ballistic trajectories and the like. The muzzle velocity is an important parameter in this context and it is of crucial importance to maintain efficient control over this. In this context, it is previously known to measure and sense the muzzle velocity and to employ such measurements and sensing for further control and prediction of the ballistic trajectory. It is also known to employ part charges which are composed or combined in the gun so as to give different ranges and muzzle velocities ($V_o$) from the gun. It is also known, on firing in the field, to remove a certain quantity of the powder from such part charges on site, which thus gives a loss of powder at the site of the gun.

SUMMARY OF THE INVENTION

The present invention is based on the concept that ammunition units which are discharged in salvos are capable of being allocated accurate muzzle velocities and that it should be possible to select them from among a number of predetermined muzzle velocities within a large velocity range. It must be possible to preplan the muzzle velocities and select them with great exactitude. According to the present invention, there will be provided an assortment of predetermined part charges which, in this instance, consist of different types and sizes.

The major object of the present invention is to provide an efficient and technically manageable system of the above-mentioned type. The present invention must be efficient to use in the field and, for example, powder loss in connection with firing need not occur.

A device according to the present invention is characterized, among other things, that a number of muzzle velocities for the ammunition units are selectable within a muzzle velocity range by a choice of combinations of previously produced part charges which, in such instance, consist of different charge types/powder varieties/powder dimensions and/or charge sizes and which are each disposed to make their contribution in the effectuated muzzle velocity of each respective combination by acting upon parameter or parameters influencing the muzzle velocity such as temperature, pressure and the like in the gun barrel. A further characterizing feature of the present invention is that the combination selections are carried out to ensure that all part charges in each respective combination will be substantially entirely combusted in the bore of the gun barrel before each respective ammunition unit departs from the muzzle of the barrel.

In one embodiment of the inventive concept as herein disclosed use is made of a first charge portion which displays a first charge weight and a powder type, a second charge portion which displays a second charge weight and a second powder type, a third charge portion which displays a third charge weight and third powder type, and so on. The powder in each respective charge portion may consist of different powder forms such as 19-hole powder, 7-hole powder or single-hole powder. The energy value of each respective powder sort may be varied in the different charges. The first charge portion can, in such instance, be allocated the largest weight, which may lie within the range of between 3.5 and 4 kg. The second charge portion is allocated the next largest weight and may display values of between 2.5 and 3.0 kg. The third charge portion is selected to be of a weight which is less than the weight of the second charge portion, for example between 0.3 and 1.0 kg for large-caliber guns and so on. The powder thickness e can be varied in the different charges. The assortment may also include a blank charge portion. The difference between the velocity stages in the upper velocity range can be selected depending upon the difference in the velocity contributions between the first and second part charges.

The total charge size or charge length may, in all cases, be of equal size from the point of view of dimensions or assume different dimensions/lengths. In the case of the same length of the different combinations, use is made, in certain combinations, of one or more blank charge portions. The number of combination parts is preferably at least three, disregarding the blank charge portion. In accordance with the above, the combinations for higher muzzle velocities may include part charges of the first type of part charges or of the first and second types of part charges. The combinations in the intermediate range for muzzle velocities comprise part charges of the first and second charge types, and the combinations for the lower muzzle velocities comprise the third charge types. One or more blank charges may, in such instance, be included in one or more of the above-mentioned combinations.

The number of possible combinations is selected to be relatively large so as to make possible fine adjustments within the muzzle velocity range. Preferably, between 25 and 50 or 55 combinations may be employed, and most preferably to combinations of 30–35.

The present invention can be combined with a pressure accumulating container or pressure actuating device on the gun. The pressure sensing device may consist of a variable additive volume connected with the charge volume by means of a nozzle so as to finely adjust the muzzle velocity. With an additive volume as large as half of the charge space and with a suitable nozzle area, $V_o$ may be adjusted by about 10 per cent. The same effect can be obtained if the nozzle area is adjustable and connected to the ambient atmosphere, which makes the additive volume in principle infinitely large. The above-mentioned pressure effectuating device is disposed, in connection with discharge of each respective ammunition unit, to control or influence the pressure in the barrel bore. By controlling the pressure in the gun barrel, the muzzle velocity can be effected. The present invention is also co-operable or amplifiable with the aid of such functions in the ammunition units as influence of the coefficient of air resistance. This latter is of particular advantage in connection with the discharge of salvos of ammunition units which are activated simultaneously at or on the target or target area. The simultaneous activation can be achieved in that the ammunition units are discharged at different angles of elevation of the gun barrel, that the ammunition units are discharged at different muzzle velocities which may then be determined by pressure (pressure profile), temperature, powder variety, charge sizes and the like. Firing tables can be employed which, on the basis of desired firing range, indicate the angle of elevation of the piece and what propellant charge is to be employed in order to obtain the correct muzzle velocities. The tables are adjusted with respect to powder category and temperature. The firing tables are entered in a calculation unit and are converted/calculated for each round by measuring $V_o$, this measurement forming the basis of the next round, and so on.

A procedure according to the foregoing which is characteristic of the present invention for selecting one of several combinations of different part charges for their composition in common charges for ammunition units which are discharged from a gun may substantially be considered as characterized in that a number of part charges including different powder dimensions/-powder varieties and/or charge sizes are stored or retrievable by/suppliable to a selector unit or selector mechanism. Firing parameters are further suppliable to devices controlling the selector unit and the compositions of the part charges in different combinations which are provided to a user are executable in dependence upon the information consisting of or extracted from the above-mentioned parameter/parameters.

Preferably, use is made of such combinations of powder that provide substantially constant pressure once pressure maximum has been achieved in the gun barrel. Stepless variation of the muzzle velocity can be achieved in that one type of charge, for example the blank charge 0, can be provided for filling with more or less loose powder (a further powder variety) on site (at the point of discharge).

As a result of the present invention as disclosed above, it will be possible to compose a system which operates with known units/standard units. Previously known composable part charges employed for discharging ammunition units from a gun barrel are known in their construction and functions, ignition principles and the like. Barrel and gun need not be modified. A highly sophisticated and accurate selection criteria can be employed for selecting the different muzzle velocities within the velocity range. Overlapping between the different velocities effectuated by the different combinations may readily be obtained if desired. By controlling the composition in dependence upon such factors as firing parameters and desires in connection with the impact on the target, risks of confusion in the compositions of the part charges can be avoided. The indication on substantially complete combustion of the charge parts in the gun barrel bore will result in obtaining a slight spread and high degree of prediction for the hit pattern of the ammunition units. As a result of the present invention, it will be possible to employ different types of powder to obtain the desired result by a combined effect.

BRIEF DESCRIPTION OF THE ACCOMPANYING DRAWINGS

One presently proposed embodiment of a device displaying the characterizing features of the present invention will be described in greater detail hereinbelow, with particular reference to the accompanying Drawings. In the accompanying Drawings.

DETAILED DESCRIPTION OF ONE PREFERRED EMBODIMENT

Figure 1:
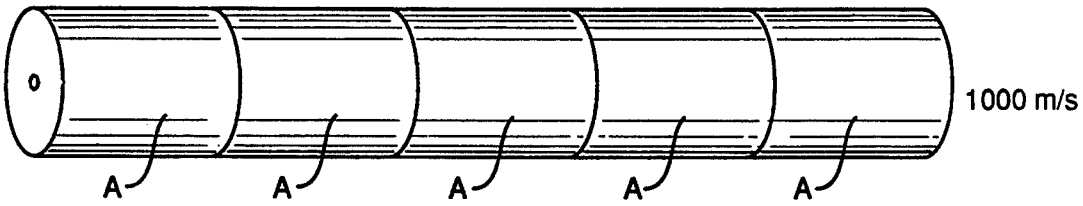
FIGS. 1–4 show, in perspective, combinations of different fixed part charges.
Figure 3:
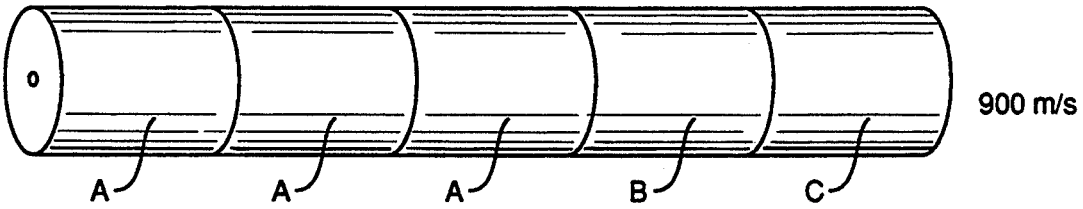
Figure 4:
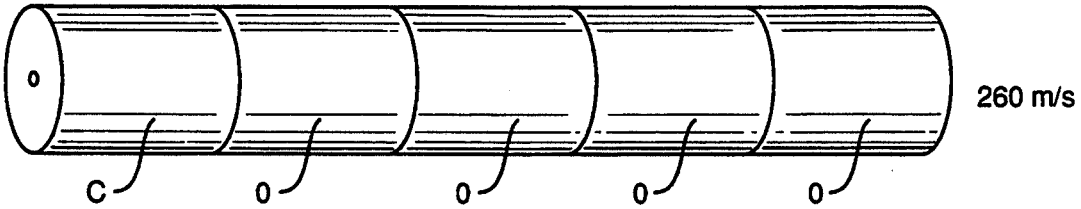
Figure 5:
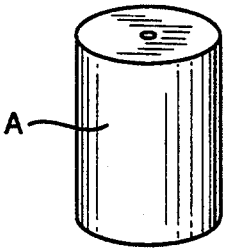
FIGS. 5–7 show, in perspective, different types of part charges which make different contributions to the muzzle velocities of the combinations.
Figure 6:
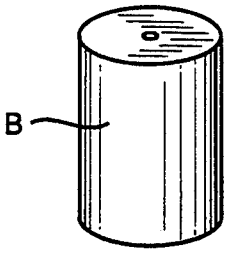
Figure 7:
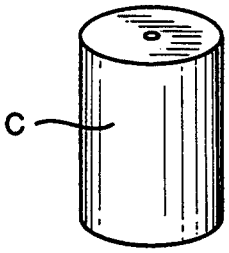

FIGS. 1–4 show different combinations of fixed part charges which in turn are individually shown in FIGS. 5, 6 and 7. In these latter figures, the pare charges are designated A, B and C, respectively. Each respective part charge is disposed to make its contribution, velocity contribution, in the muzzle velocity effectuated by each respective combination. Charge A makes a contribution of 221 m/s, part charge B, a contribution of 195 m/s and part charge C a contribution of 654 m/s. The part charges can be designed for other velocity contributions. The number of part charges may also vary, but should be at least three in number. In FIG. 1, 5 part charges A have been provided in the combination shown in FIG. 1. Together, the part charges give a muzzle velocity which is at maximum, for example 1,000, at a powder temperature of about 200.

Figure 2:
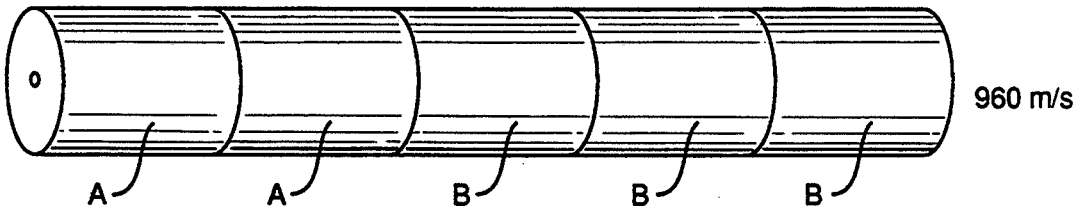

The combination according to FIG. 2 correspondingly shows that two part charges A have been combined with three part charges B and that the part charges, in combination together, effectuate a muzzle velocity of 960 m/s for the ammunition unit in question. FIG. 3 shows a further combination in which are included at least three part charges 5A, one part charge B and one part charge C, which together give a muzzle velocity which is ten per cent lower than the maximum, for example about 900 m/s. FIG. 4 shows a combination which gives the slowest muzzle velocity which is achieved with the aid of a charge C and four blank charges 0. In certain contexts, it is essential that the combination of part charges can include a predetermined given length L. In this case and in certain combinations, the above-mentioned blank charges 0 must in such instance be employed. The latter blank charges can make the contribution 0 m/s. All part charges are built with combustible cases of a known type.

Figure 8:
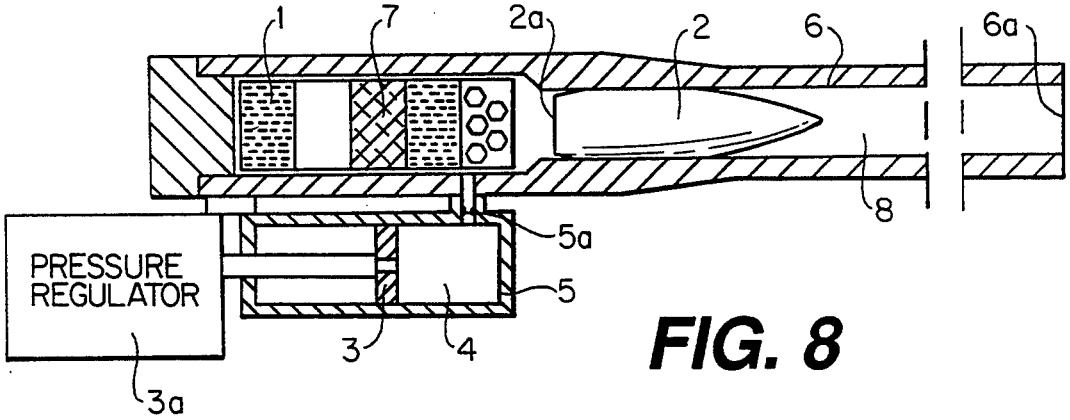
FIG. 8 is a side elevation symbolically showing a pressure-accommodating device at a gun (shown in part)

It will readily be perceived that solely with the aid of three different fixed part charges, it is possible to achieve a large selection of muzzle velocities. In the present case, the part charges are employed in 33 different combinations, each giving their unique muzzle velocity for the ammunition units in question. The present invention is intended to be utilized in connection with the combatting process as disclosed in Swedish patent specification 8902329-5 corresponding to U.S. Pat. No. 5,121,672 which shows how a target area is combatted with the aid of ammunition units discharged in a salvo from one or more guns and in which the ammunition units are brought to activation at substantially the same point in time. In FIG. 8, reference numeral 1 refers to a gun and an ammunition unit loaded in the gun is designated 2. The gun is fitted with pressure activating devices in the form of a hydraulic ram 3 connected to pressure regulator 3*a* which regulates a space 4 in a cylinder 5. The cylinder space 4 is in contact with the rear plane 2*a* of the ammunition unit in connection with discharge of the ammunition unit from the barrel 6 of the gun. Like the ammunition temperature, the pressure constitutes an essential parameter for the muzzle velocity $V_o$ of the ammunition unit. In the gun, a charge composed of part charges is designated by numeral 7. Activation of the charge 7 entails pressure and temperature elevations in the bore 8 of the barrel behind the ammunition unit. It will be seen that a volume and thereby pressure regulation by means of the devices 3, 5 has an effect on the muzzle velocity of the ammunition unit. The pressure wave is dependent upon the size area of the nozzle 5*a* in relation to the combustion properties of the powder being dependent upon the pressure. One essential characterizing feature of the present invention is that the part charges in the charge 7 must have completely combusted before the ammunition unit departs from the barrel muzzle 6*a*. The present invention must also be capable of employment in co-operation with target combatting processes pursuant to Swedish patent specification No. 8301651-9 corresponding to U.S. Pat. No. 4,655,411 in which the ammunition units are fitted with devices which may be influenced by the coefficient of air resistance and which are activated in the ballistic trajectories of the ammunition units such that the ammunition units, in one way or another, are retarded in order to be able to come down on an exactly predetermined point. The present inventive concepts can also be combined with this known process. It is also possible to combat two or more different targets at the same time.

Figure 9:
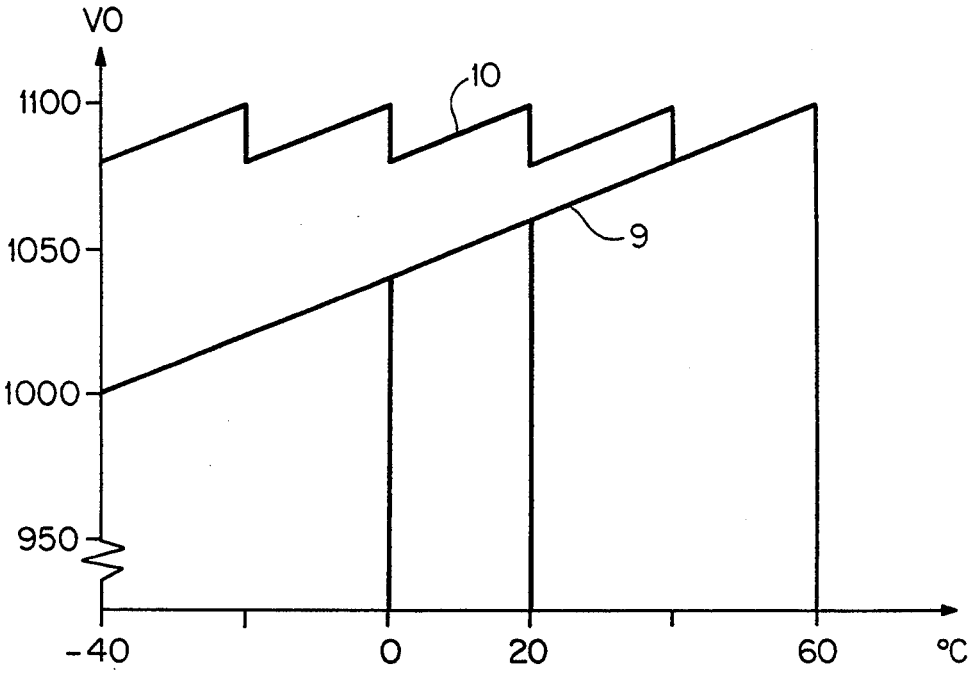
FIG. 9 shows, in a diagram form, the muzzle velocities at different elevations in previously known systems, and the new system with fixed part charges, respectively.

FIG. 9 shows a curve 9 which gives the relationship between the muzzle velocity $V_o$ and the temperature off the powder. It will be apparent from the curve that the muzzle velocity increases with the temperature of the powder. If the velocity is about 950 m/s≈1,000 m/s at −40° C., it will be 1,100 m/s at +60° C. The diagram also shows how it is possible to maintain substantially constant the muzzle velocity $V_o$ throughout the entire temperature range of the gun with the aid of the above-mentioned combinations of fixed part charges with different compositions. The characteristic effectuated by the part charge combinations for the muzzle velocity is apparent from curve 10 in FIG. 9.

Figure 10:
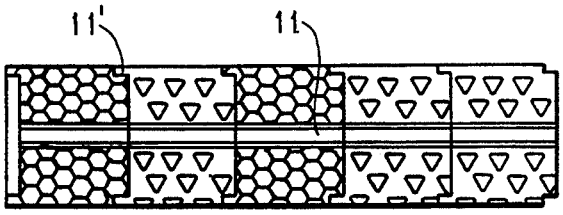
FIG. 10 is a view from the side showing the physical composition of the parts.

In accordance with the foregoing, the composition of the part charges may be effected in a known manner such that an expedient ignition of the part charges is effectuated in the position of the charge in the gun. Thus, for example, according to FIG. 10 a central through-channel 11 may be provided in the part charge system. Via this channel, pyrotechnical ignition gases can spread and ignite the part charges in a known manner. This principle is known in the art and will not be described in greater detail here.

Figure 11:
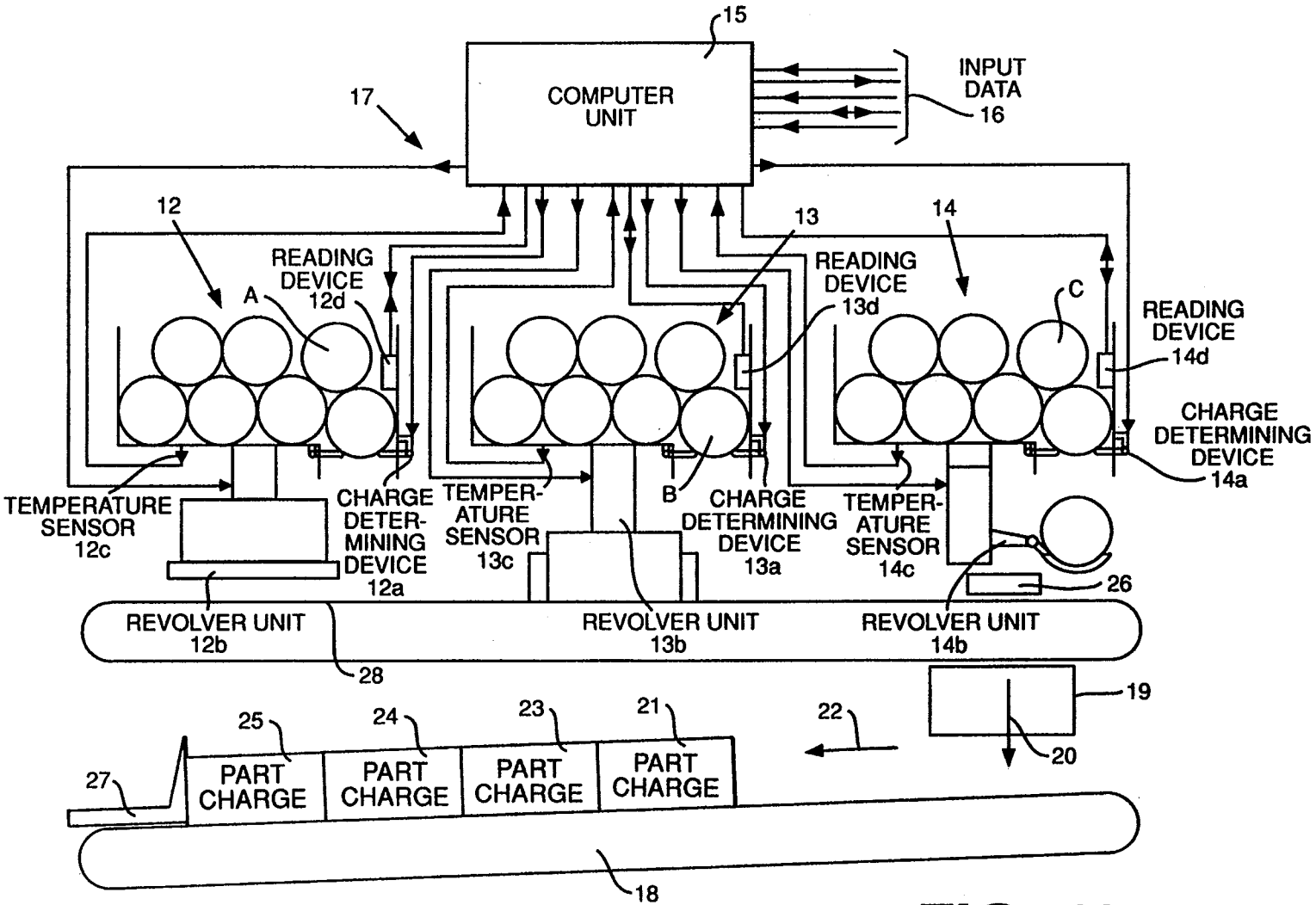
FIG. 11 shows, in a diagram form, an apparatus which composes the part charges into combinations in dependence upon incoming control signals.

FIG. 11 shows an apparatus for composing and selecting the part charges in each respective combination. The apparatus comprises magazines 12, 13 and 14 and so on for the different part charge types A, B, C. In this figure, the magazine for loading 0 is not included, but this magazine part may be of the same design and construction as 12, 13 or 14. No temperature sensor 12*c* is required for this magazine part, since its temperature addition influences the pressure but minimally and, as a result, makes no addition to the muzzle velocity. A device 15, for instance in the form of a microcomputer, is provided to receive information 16 in respect of the firing parameter which are to apply to the case in question. Such firing parameters may be firing range, temperature, wind, flight times for the ammunition units, as well as the pertinent powder temperature. The parameters in question are to be employed as a basis for calculating the relevant muzzle velocity which is to apply for the shoot in question. With the aid of this information, signals 17 are outputted and control the discharge of the part charges A, B and C. Each respective magazine includes a discharge determining device 12*a*, 13*a* and 14*a*. These latter devices are activated one at a time and, on each respective activation, the relevant part charge is discharged from the relevant magazine. Beneath each magazine, there is disposed a revolver unit 12*b*, 13*b*, 14*b*, respectively. Each respective unit has a reception position which extends at right angles to the plane of the figure for each respective falling part charge A, B, C, respectively. The units 12*b*, 13*b* and 14*b* can, once they have received their part charge, revolve through 90 and enter a discharge position as apparent from FIG. 11. In this discharge position, each respective part charge falls down onto a path 18 (in this case inclining) on which the successively falling part charges assume positions after one another. In the figure, four part charges have taken up their positions disposed after one another on the path 18. The fifth part charge 19 is in the process of falling in the direction of the arrow 20 down towards the upper phase of the path 18. When the part charge 19 falls down onto the path, if will be advanced thereby to a position after the part charge 21. The direction of advancement of the path is indicated by reference 22, and remaining charges in the combination are disclosed by reference No. 23, 24 and 25. The part charges can be anchored to one another in a known manner 11' (see FIG. 10) using known means, and be transferred to the gun.

More specifically, it can be stated that FIG. 11 shows how the revolver unit 14*b* is in its collection position. Collecting proceeds such that 14*b* moves up into an upper position. When it is in this position, 14*a* opens and a part charge falls down. The unit 14*b* is thereafter lowered and, at a given suitable position 14*a* closes so that no more than one charge unit accompanies 14*b*. The revolver unit 12*b* is placed in that position where it has rotated through 90° and is ready to transfer the part charge to the conveyor belt 28. The revolver unit 13*b* has dropped down its retainer for the part charge so that this falls/rolls down onto the conveyor belt 28. When the part charge arrives facing 26, this pushes the part charge 19 off the belt 28 so that it falls down onto the conveyor belt 18.

In an alternative embodiment, it is conceivable that the trajectory calculation proper is effected by means of a second calculator and, in this case, only the desired muzzle velocity need be transmitted to 15 via 16. Data concerning the gun and the different power varieties can possibly also be transferred to 15 via 16. The unit 15 may thereafter itself read off what type of powder is in place in each respective magazine 12, 13 and 14 via, for instance, a bar coding on each charge, which is effected using the equipment **12*d*, 13*d* and 14*d*. In certain cases, it may be of interest to measure the temperature of the powder, which can be carried out with the aid of temperature sensors 12*c*, 13*c* and 14*c* which, in this case, are connected directly to 15. In such instance, the unit 15 houses a database, and calculation documentation which describes how the gun, the charges and the projectile behave in combination. On the basis of this data and possible calculating functions, 15** is capable of making a combination of charges from A, B and C, which gives the desired muzzle velocity. Alternatively, it can calculate that muzzle velocity which will be obtained in a given combination and transfer this information to another superordinate unit. On the basis of the thus obtained muzzle velocity, the superordinate unit can then calculate elevation, air resistance, splitting altitude/time and the time from discharge until the time the projectile has reached its target. Using this information as a point of departure, the superordinate control equipment can then issue a command for time of firing, elevation, air resistance and splitting altitudes/time, and/or corrections of various types in the trajectory at different times and/or altitudes, and by such means ensure that the projectiles reach the desired target at the correct point in time.

The equipment described with particular reference to FIG. 11 may be mounted on the gun or on a loading vehicle in the gun unit 5–50 meters off, or if the loading equipment provides service for several guns, at a central point between 50 and 400 meters from the gun line. Once the part charges have been combined into five-unit or n-unit charges, this unit is to be transferred to the barrel of the gun. This may be effected manually in that the charge is collected from the conveyor belt 18 and placed in the loading space 7 of the gun. Transfer of the charge can also be effected using conveyor belts all or part of the way from the unit in FIG. 11 to the gun barrel 8. If the equipment is mounted directly on the gun, the charges can be transferred manually or automatically to a magazine, whence they, together with or separately from the projectile, may rapidly be fed into the gun for achieving short times of between 2 and 10 seconds between rounds. The procedure of combining charges can be carried out within 3–10 seconds, during which time loading and firing can be carried out simultaneously, which entails that the intermediate magazine can be dispensed with. This is a major advantage if the magazine is as small as possible in those cases when firing must be discontinued or if another target is to be combatted. In most cases, new combinations of charges will then be needed, for which reason those combinations already made must be removed and/or returned as part charges to each respective magazine 12, 13 and 14.

The invention may primarily be employed on large caliber guns.

The present invention should not be considered as restricted to that described and shown on the drawings, many modifications being conceivable without departing from the spirit and scope of the appended claims.

What we claim is desire to secure by Letters Patent is:

1. A device for controlling discharge of ammunition units from the barrel of a gun in sequence with muzzle velocities within a large velocity range, to enable simultaneous activation of the ammunition units on a target area, said device comprising:

a plurality of part charges having different predetermined compositions including sizes, types, powder varieties, powder dimensions, said plurality of part charges being combinable into plurality of selected combinations defining total charges;

controlling means for receiving information regarding the firing parameters and parameters influencing muzzle velocity including a powder temperature of the part charges and pressure in the gun barrel and for calculating relevant velocities from said large range of velocities which allow for plurality of sequentially fired ammunition units to simultaneously arrive at said target area; and selecting means responsive to said controlling means for selecting from said plurality of part charges, based on said calculated velocities, corresponding combinations of part charges to define said total charges for respective ammunition units which allow to achieve said calculated velocities with high accuracy and wherein the number of combinations combinable from said plurality of part charges is in a range of between 25 and 55 such that said muzzle velocities can be accurately controlled at small intervals in a range between 10 and 55 m/s.

2. A device according to claims 1 wherein said combinations of part charges selected by said selecting means ensure that all part charges in each respective combination are completely combusted in the bore of the gun barrel before each respective ammunition unit departs from the muzzle of the gun barrel.

3. The device as claimed in claim 1, wherein a first part charge in a selected combination has a first charge weight and a first powder variety;

a second part charge has a second charge weight and a second powder variety; and a third part charge has a third charge weight and a third powder variety, and so on.

4. The device as claimed in claim 1, wherein each respective part charge comprises 19-hole powder, 7-hole powder or single-hole powder, the energy value of each respective powder variety being about 700–900 cal/g.

5. The device as claimed in claim 1, wherein the first part charge portion in a selected combination has the highest weight of about 3.5–4.0 kg, the second part charge has a weight of about 2.5–3.0 kg, the third part charge has a weight which is less than the second charge weight of about 0.3–0.8 kg, and so on and wherein at least one of said combinations includes a blank charge portion.

6. The device as claimed in claim 1 wherein said total charge includes at least three part charges and wherein the combinations for higher muzzle velocities comprise part charges of a first type of charges or of the first and second charge types, the combinations in the intermediate range for muzzle velocities comprise part charges with at least one of the first and second charge types, and combinations for the lower muzzle velocities comprise third charge types, and wherein at least one blank charge may be included in each respective combination.

7. The device as claimed in claim 1, further including pressure-actuating means mounted at the gun for controlling, in connection with the firing of each respective ammunition, the pressure in the gun barrel bore.

8. A method for controlling discharge of ammunition units from the barrel of a gun in sequence with a large range of controlled muzzle velocities, to enable simultaneous activation of the ammunition units on a target area, said method comprising the steps of:

providing a plurality of part charges having predetermined parameters including sizes, types, powder varieties, powder dimensions, said plurality of part charges being combinable into plurality of selected combinations defining total charges;

obtaining and inputting information regarding the firing parameters and parameters influencing muzzle velocity including temperature and pressure into a control unit;

determining in said control unit relevant velocities from said large range of velocities which allow for plurality of fired charges to simultaneously arrive at a target;

selecting from said plurality of part charges, based on said velocities, corresponding combinations of part charges to define total charges for respective ammunition units which allow to achieve said determined velocities;

wherein the number of possible combinations of part charges in a range of about 25 to 55 which allows for accurate control of said muzzle velocities within a high range of between 250–1000 m/s at small intervals.

* * * * *

UNITED STATES PATENT AND TRADEMARK OFFICE

CERTIFICATE OF CORRECTION

PATENT NO. : 5,337,649

DATED : August 16, 1994

INVENTOR(S) : Arne Franzen et al.

It is certified that error appears in the above-indentified patent and that said Letters Patent is hereby corrected as shown below:

In the Claims:

Column 10, line 15:

Claim 8, fourth line from the end, please insert --is-- before "in".

Signed and Sealed this

Fourth Day of April, 1995

Bruce Lehman

*Attest:*

BRUCE LEHMAN

*Attesting Officer*

*Commissioner of Patents and Trademarks*